US011454076B2

(12) United States Patent
Ludwig et al.

(10) Patent No.: US 11,454,076 B2
(45) Date of Patent: Sep. 27, 2022

(54) METHOD FOR SYNCHRONIZING DOWNHOLE TRACTOR AND WINCH DEPLOYMENT

(71) Applicant: Halliburton Energy Services, Inc., Houston, TX (US)

(72) Inventors: Wesley N. Ludwig, Fort Worth, TX (US); Sudhir K. Gupta, Kingwood, TX (US); Yuan Qi, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/177,078

(22) Filed: Feb. 16, 2021

(65) Prior Publication Data

US 2021/0164309 A1 Jun. 3, 2021

Related U.S. Application Data

(63) Continuation-in-part of application No. 16/446,243, filed on Jun. 19, 2019, now abandoned.

(51) Int. Cl.

| | |
|---|---|
| ***B66D 1/50*** | (2006.01) |
| ***E21B 23/14*** | (2006.01) |
| ***E21B 17/20*** | (2006.01) |

(52) U.S. Cl.

CPC ..... *E21B 23/14* (2013.01); *B66D 1/505* (2013.01); *E21B 17/20* (2013.01)

(58) Field of Classification Search

CPC ..... E21B 23/14; E21B 17/023; E21B 17/20; E21B 47/12; E21B 2023/008; B66D 1/505

See application file for complete search history.

(56) References Cited

U.S. PATENT DOCUMENTS

| | | | | |
|---|---|---|---|---|
| 5,155,922 | A | 10/1992 | Cooper | |
| 7,900,893 | B2 | 3/2011 | Teurlay et al. | |
| 9,988,898 | B2 * | 6/2018 | McColphin | E21B 47/09 |
| 2008/0216554 | A1 | 9/2008 | McKee | |
| 2010/0319910 | A1 | 12/2010 | Ives et al. | |
| 2012/0085531 | A1 * | 4/2012 | Leising | E21B 47/00 166/77.2 |
| 2013/0138254 | A1 | 5/2013 | Seals et al. | |
| 2015/0167416 | A1 | 6/2015 | Ludwig | |
| 2016/0076325 | A1 * | 3/2016 | Dykstra | E21B 47/09 166/255.1 |
| 2017/0145760 | A1 | 5/2017 | Poyet et al. | |
| 2019/0203575 | A1 * | 7/2019 | Schlosser | B66D 1/505 |

FOREIGN PATENT DOCUMENTS

WO 2018026744 A1 2/2018

OTHER PUBLICATIONS

International Search Report & Written Opinion in PCT/US2019/038025, dated Mar. 19, 2020.

* cited by examiner

*Primary Examiner* — Taras P Bemko
(74) *Attorney, Agent, or Firm* — McGuireWoods LLP

(57) ABSTRACT

A method for synchronizing downhole tractor and surface winch deployment includes inserting into a wellbore a tool string connected to a wireline, where the tool string includes a variable speed tractor. The method also includes deploying the tractor, and deploying the wireline from a winch. The method further includes dynamically monitoring, by a device disposed downhole, a wireline tension as an indicator of synchronization of the tractor and winch.

20 Claims, 4 Drawing Sheets

METHOD FOR SYNCHRONIZING DOWNHOLE TRACTOR AND WINCH DEPLOYMENT

CROSS-REFERENCE TO RELATED APPLICATIONS

This application is a continuation-in-part of U.S. patent application Ser. No. 16/446,243 filed on Jun. 19, 2019 entitled "Method for Synchronizing Downhole Tractor and Winch Deployment", which claims the benefit of International PCT Application No. PCT/US2019/038025, filed on Jun. 19, 2019, both of which are incorporated herein by reference.

BACKGROUND

The present disclosure relates generally to the field of oil and gas production and more specifically to methods for running tools into a deviated wellbore with the use of a wireline tractor. The present disclosure further relates to methods for synchronizing a wireline tractor with the relevant wireline winch deployment to avoid line slack and/or wasted power and traction.

After a wellbore is drilled it will need to be completed, involving a variety of different completion operations to be performed within the well with a variety of different tools. During the life of the well interventional operations may be needed. For a conventional vertical well these operations may be completed with the use of a spool of wireline cable, slickline, coiled tubing or other conveyance line that is hung into the well and the location of a tool is determined by letting out enough wireline with use of a winch to enable gravity to bring the tool to the desired depth.

However, providing downhole access to wells that are deviated, such as for a horizontally drilled well, require more than simply dropping a wireline into the well with the applicable tool located at the end thereof and letting gravity position the tool. In this type of well a wireline tractor can be used to position the tool into the more distal regions of the wellbore while the winch lets out a corresponding amount of wireline.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

Figure 1:
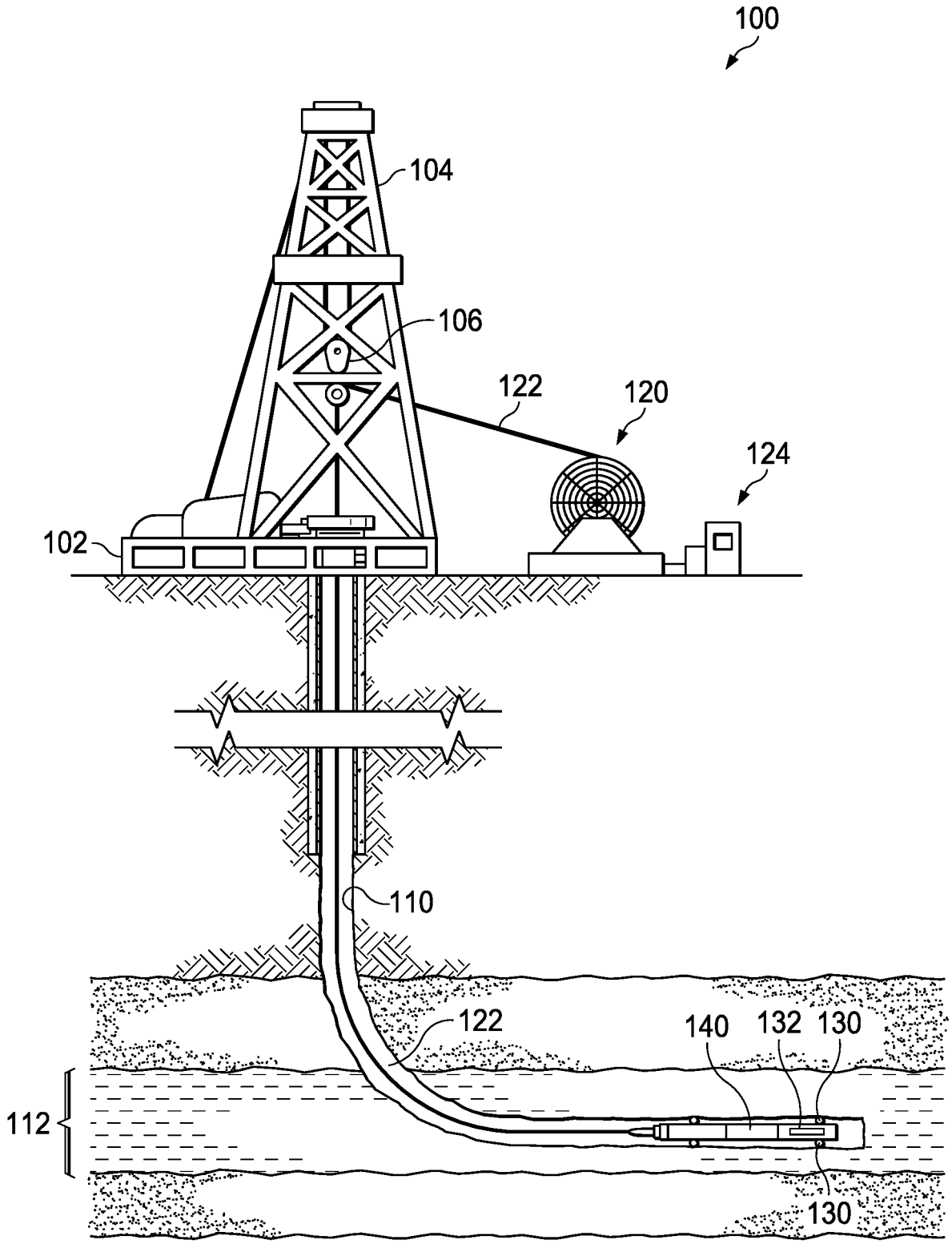
FIG. 1 illustrates a land-based oil and gas rig including a downhole wireline tractor system in an embodiment of the present disclosure.

While certain embodiments and aspects of the subject technology are depicted in the drawings, those skilled in the art will appreciate that the embodiments and aspects depicted are illustrative and that variations of those shown, as well as other embodiments and aspects described herein, may be envisioned and practiced within the scope of the present disclosure.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Therefore, the description that follows is not to be taken as limiting on the scope or applications of the appended claims. In particular, an element associated with a particular embodiment should not be limited to association with that particular embodiment but should be assumed to be capable of association with any embodiment discussed herein.

Various elements of the embodiments may be described with reference to their normal positions when used in a wellbore. For example, a tool may be described as being below or downhole from a crossover. For vertical wells, the tool will actually be located below the crossover. For horizontal wells, the tool may be horizontally displaced from the crossover, but will be farther from the surface location of the well as measured through the well. Downhole or below as used herein refers to a position in a well farther from the surface location in the well.

The present disclosure relates generally to the field of oil and gas exploration and production and more specifically to methods for running tools into a deviated wellbore with the use of a wireline tractor. The present disclosure further relates to methods for synchronizing a wireline tractor with the relevant wireline winch deployment to avoid wireline slack and/or wasted power and traction.

As used herein the term "wireline" shall be meant to construe a wireline cable, a slickline, a coiled tubing string, or any other conveyance line that is run into a well to deliver a tool or measurement item. The tool or measurement item can include a tractor affixed to the wireline that is used to convey the tool or measurement item into a deviated wellbore where gravity alone is insufficient to position the tool or measurement item to the desired location.

As used herein the term "nominal" shall be meant to construe a value that is not absolute but can have some variation thereto. For example the phrase "same nominal speed" would mean that the two items being compared have approximately the same speed, but not necessarily identical speeds. The speeds may vary for example by 2%, so the speeds are not identical but are nonetheless a close approximation of the same speed. If a tractor and winch are said to have the same nominal speed, it can mean that the tractor and winch speeds substantially match each other. As a further example the phrase "same nominal time" would mean that the two events being compared are done at approximately the same time, but not necessarily at precisely the same time. The times may vary for example by a few seconds, so the times are not identical, but are nonetheless a close approximation of the same time.

The tractor movement and winch movement are synchronized, as further described below, for the most effective use of the equipment and to avoid problems that can occur if the movements are sufficiently different. Desirably, the disclosure may avoid a situation where the tractor runs faster than the winch, in which case the tractor would otherwise be pulling against the winch, wasting power and traction that could otherwise be utilized for conveying the payload. It may also avoid a situation where the winch is running appreciably faster than the tractor, in which case slack in the wireline can build up in the hole and the wireline could tangle or cause depth control problems.

Referring to the drawings in detail, wherein like numerals denote identical elements throughout the several views, there is shown in FIG. 1, a land-based rig 100 including a winch 120, wireline 122 and tractor 130 operational system in an illustrative wellbore application, according to the one or more embodiments. It should be noted that, even though FIG. 1 depicts a land-based rig 100, the exemplary winch 120 and tractor 130 operational system, and its various embodiments disclosed herein, are equally well suited for use in or on other types of rigs, such as offshore platforms or rigs arranged in any other geographical location.

Figure 6:
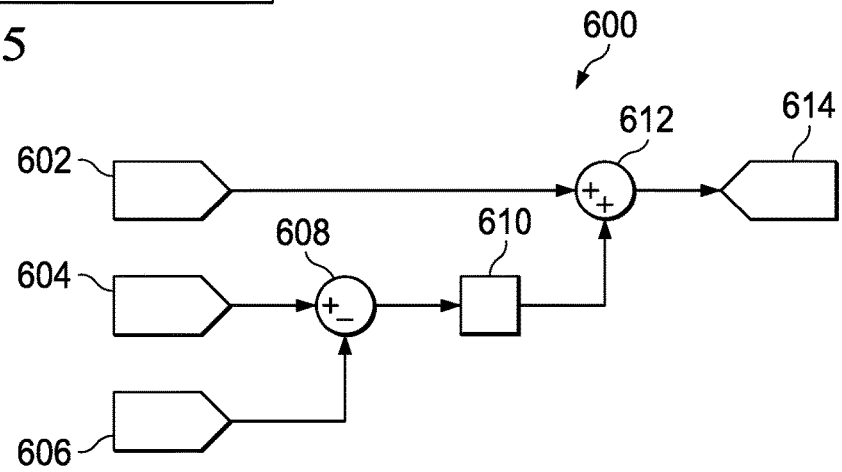
FIG. 6 is a system diagram of a downhole tractor synchronization system, in accordance with an embodiment of the present disclosure.
Figure 7:
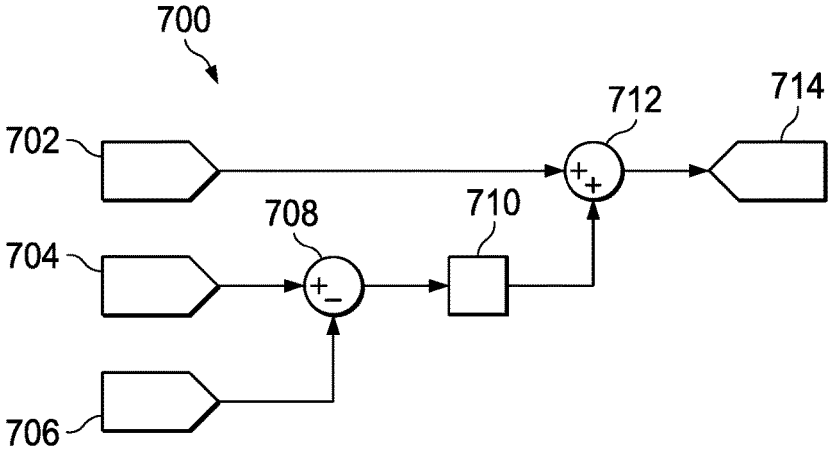
FIG. 7 is another system diagram of the downhole tractor synchronization system, in accordance with another embodiment of the present disclosure.
Figure 8:
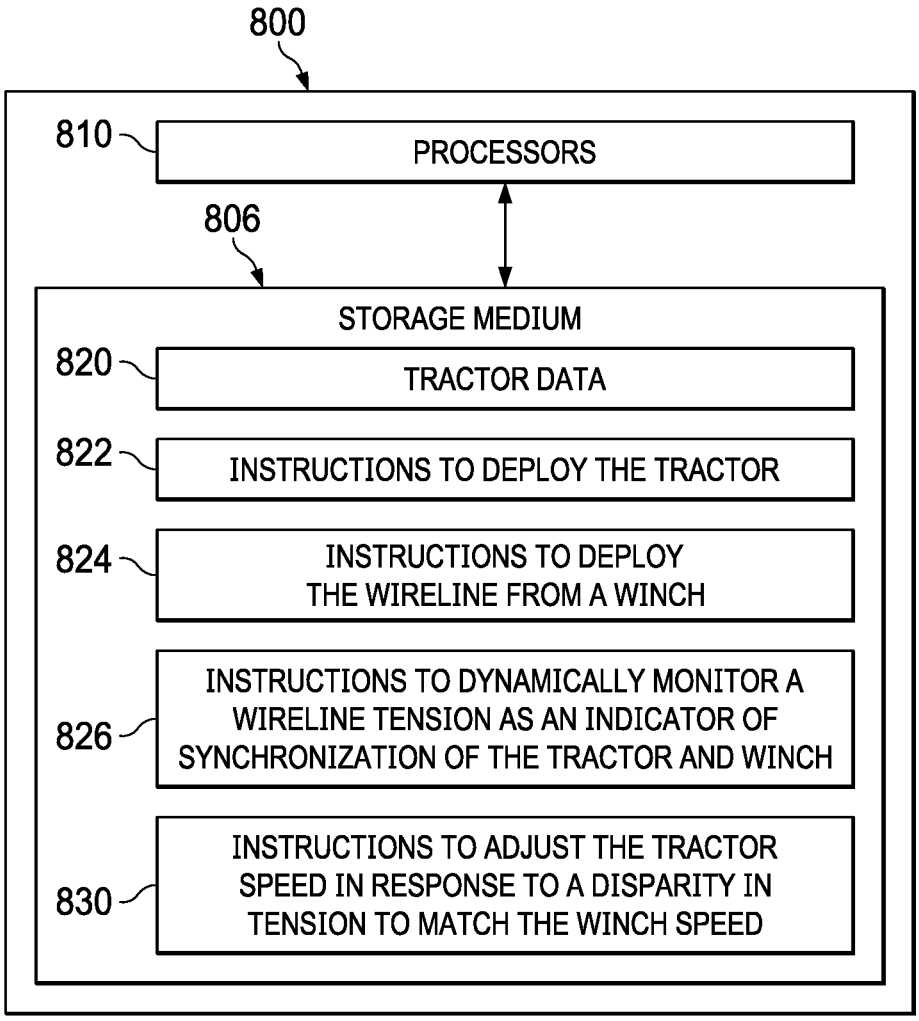
FIG. 8 is a block diagram of the downhole tractor synchronization system of the tractor of FIG. 1.

As illustrated in FIG. 1, depicts a land-based rig 100 includes a platform 102 that supports a derrick 104 having a traveling block 106 for raising and lowering items into and out of a wellbore 110. A wireline 122 extending from a winch 120 conveys a tool string 140 into the wellbore 110 and into a desired formation 112. The tool string 140 is assisted in reaching into the distal end of the wellbore 110 with the help of a tractor device 130. The winch 120 controls the speed that the wireline 122 is rolled on/off the winch and into/out of the wellbore 110. The tractor 130 can expend energy to pull the tool string 140 into the distal end of the wellbore 110. In the embodiment of FIG. 1, a device 132 that is configured to adjust the tractor speed or the tractor torque is a component of, or is disposed on the tractor 132. As referred to herein, a device is any electronic component or device that is in communication with the tractor 130 and is configured to adjust the tractor speed or the tractor torque by performing one or more operations described herein. In some embodiments, the device 132 is a proportional-integral (PI) controller. In some embodiments, the device 132 is a proportional-integral-derivate (PID) controller. Additional descriptions of the device 132 and operations performed by the controller are provided herein and are illustrated in at least FIGS. 5-8. In the embodiment of FIG. 1, the device 132 is a component of a downhole tractor synchronization system that is illustrated in FIGS. 6-8. In one or more of such embodiments, all of the components of the downhole tractor synchronization system are deployed downhole. In one or more of such embodiments, where the downhole tractor synchronization system also includes mechanical components, certain components of the downhole tractor synchronization system, such as the winch 120, are deployed on the surface, while other components, such as the device 132, are deployed downhole. In some embodiments, one or more controllers (not shown) similar to the device 132 and configured to perform operations of the device 132 is deployed in a downhole location. An optional control/information center 124 can monitor and control the winch 120 operation.

Figure 2:
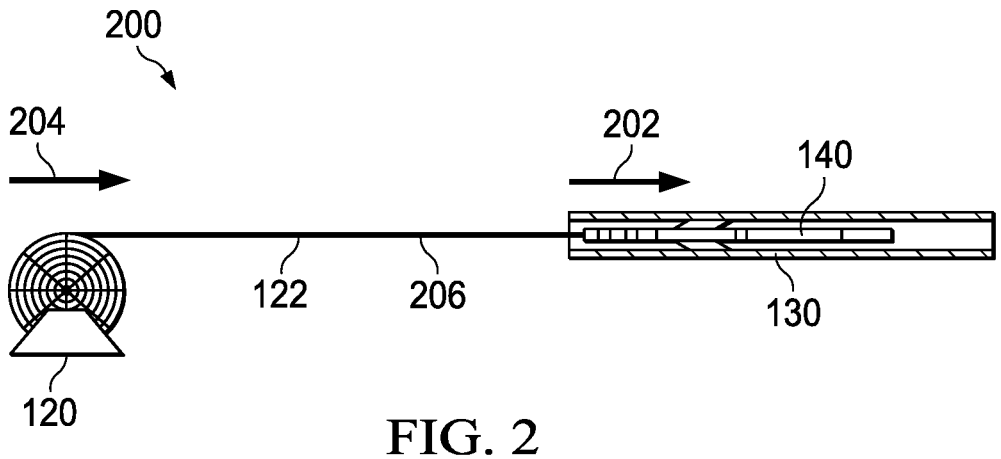
FIG. 2 illustrates an example of a winch/tractor arrangement according to an embodiment of the present disclosure.

Referring now to FIG. 2, illustrated is an example of a winch 120, wireline 122 and tractor 130 arrangement 200 when a tractor speed 202 is greater than the corresponding winch speed 204 resulting in a tight wireline 206. This scenario results in a waste of power and traction as the tractor 130 is working harder than necessary to convey the tool string 140 to the desired position.

Figure 3:
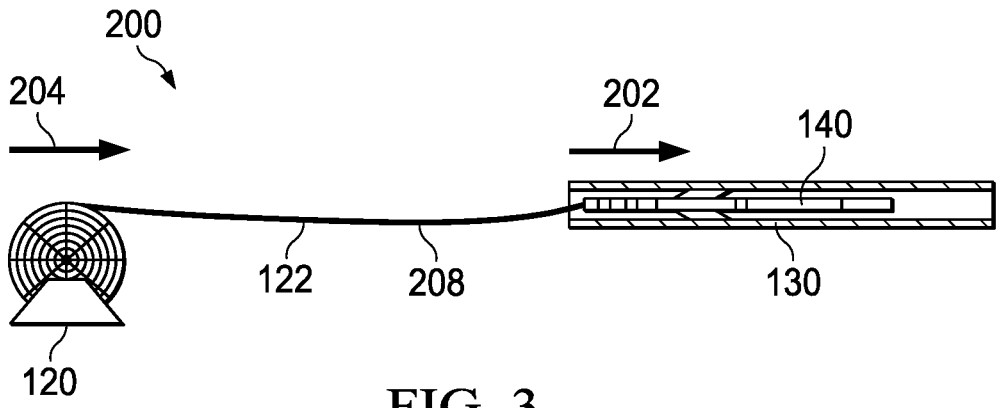
FIG. 3 illustrates an example of a winch/tractor arrangement according to an embodiment of the present disclosure.

Referring now to FIG. 3, illustrated is an example of a winch 120, wireline 122 and tractor 130 arrangement 200 when a tractor speed 202 is running at the same speed as the corresponding winch speed 204, resulting in a small amount of slack in the wireline 208. This scenario avoids excessive wireline pull as the tractor 130 is working no more than is necessary to convey the tool string 140 to the desired position. This scenario avoids excessive wireline pull as well as excessive slack.

Figure 4:
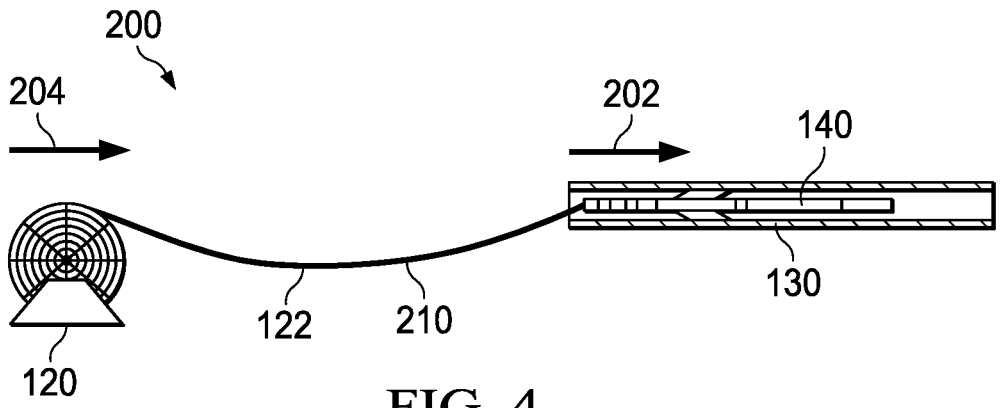
FIG. 4 illustrates an example of a winch/tractor arrangement according to an embodiment of the present disclosure.

Referring now to FIG. 4, illustrated is an example of a winch 120, wireline 122 and tractor 130 arrangement 200 when a tractor speed 202 is less than the corresponding winch speed 204. This scenario results in an excessive and ever increasing slack in the wireline 210. In the case of wireline or slickline, this lack of tension in the wireline may result in knotting, unwinding of braided cable, entanglement of the wireline with a tractor or other downhole tools or a variety of other undesirable conditions. Such inadequate wireline tension can occur through a deviated well where slack in the wireline may accumulate near the "elbow" transition between the vertical and horizontal well sections. For example, a wireline may be of sufficient tension in a vertical well section due to its own weight, but this same wireline may actually be in a low or even zero tension state within the horizontal well section near, and downhole of, the noted elbow.

Figure 5:
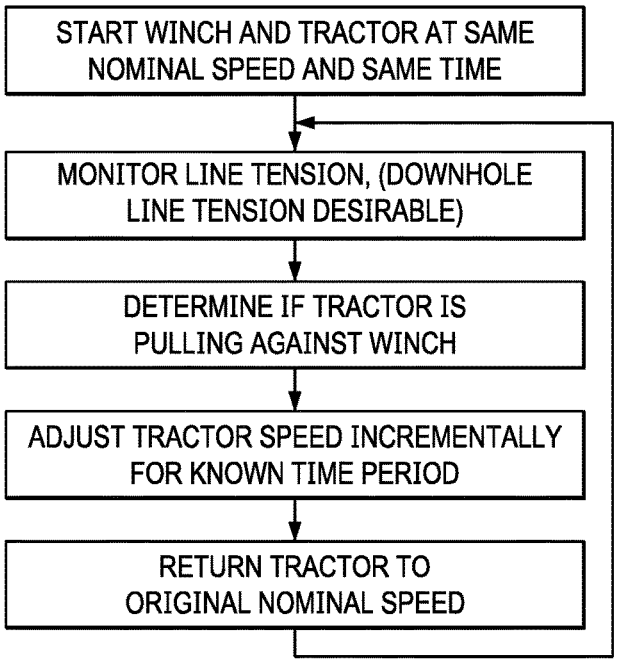
FIG. 5 is a block flow diagram of a method to synchronize a tractor and winch operation, in accordance with an embodiment of the present disclosure.

Referring now to FIG. 5, illustrated is a block diagram of a method to synchronize the tractor and winch operations, according to one or more embodiments of the disclosure. In the embodiment of FIG. 1, operations to synchronize the tractor and winch operations are performed by the device 132 of the tractor 130. In some embodiments, operations described herein are performed by another downhole electronic component of a tractor, or an electronic component that is deployed downhole.

An embodiment of the present disclosure is a method of synchronizing a winch and tractor operation to minimize tractor pull on the winch and prevent excessive amounts of slack in the wireline.

The method involves operating the winch and tractor at nominally the same speeds. Instead of adjusting the winch speed to match the tractor, the tractor speed is adjusted to match the winch. In one illustrative embodiment a tractor speed can be precisely adjusted by sending commands to the tractor from the surface system. After the winch and tractor have been started to approximately the same nominal speed, the tractor speed will be adjusted to match the winch speed.

Downhole tension is best observed to make the speed corrections. In an embodiment the tractor is powered by use of conductors in a wireline capable of sending power of a useful quantity through the wireline to the tractor while control and data signals are also sent over the wireline. In alternate embodiments the tractor is powered by batteries that are located within or adjacent to the tractor, while control and data signals are sent over the digital slickline, such as the Relay™ Digital Slickline System offered by Halliburton® or alternate data transmission system for tractor control.

If the tractor is moving slower than the winch, the tension in the wireline will be relatively unchanging. If this is observed the tractor speed can be incrementally increased until the wireline tension starts to increase. Because the tractor speed was incrementally increased to match the winch speed, the tractor is now moving at a bounded amount faster than the winch.

If the tractor is trying to move faster than the winch, the wireline tension will tend to increase. If this happens the tractor speed can be incrementally slowed until the tractor speed and winch speed match, at which time the tension should stabilize.

It should be recognized that small errors in synchronization between the winch and tractor are going to continually occur. Small corrections can be made to the tractor speed whereas small corrections can be very difficult to make with some winch systems.

While the goal is to run the winch and tractor at the exact same speed, we can only realistically expect to synchronize the speeds within an acceptable error band. When the winch and tractor are running at some small speed difference, the amount of winch travel compared to the amount of tractor travel can become larger than desired over time. The downhole tension on the wireline can be observed to determine when to make corrections to add or take up slack. Non-limiting examples of an acceptable error band, can be plus or minus 1% of the value, optionally plus or minus 2% of the value, optionally plus or minus 3% of the value, optionally plus or minus 5% of the value, optionally plus or minus 10% of the value, optionally plus or minus 15% of the value.

Once a steady state is reached, the tractor and winch should be running at close to the same speed, but of course the speeds will not match exactly. It may be easier to periodically add or remove some slack than keep trying to more closely match the speed. If the tractor speed is incrementally increased by 1 ft/min for 1 minute and then returned to the original speed, then 1 foot of slack should be removed between the winch and the tractor and the winch and tractor should again be running at close to the same speed. If the tractor speed is incrementally decreased by 1 ft/min for 1 minute and then returned to the original speed, then 1 foot of slack should be introduced between the winch and the tractor.

After operating the tractor and winch in close synchronization for some time, the tractor may be slightly outrunning the winch, which would be evidenced by an increase in wireline tension. The tractor can be slowed down a small amount for a short period of time to correct for this increase in wireline tension. This action should result in a drop in wireline tension when the slack is added. For example, if the tractor speed is incrementally decreased by 1 ft/min for a 1 minute interval and then returned to the previous speed, then 1 foot of slack should be introduced between the winch and the tractor resulting in a reduction or elimination of the increase in wireline tension that was observed. This can be repeated until a stabilization or decrease in wireline tension is noted. Non-limiting examples of an increase in wireline tension can be an increase of 1% of the wireline tension value, optionally an increase of 2% of the value, optionally an increase of 3% of the value, optionally an increase of 5% of the value, optionally an increase of 10% of the value.

After operating the tractor and winch in close synchronization for some time, the tractor may be moving slightly slower than the winch. This may be evidenced by unchanging wireline tension and is an indication of slack in the wireline. To check for this the tractor speed can be increased a small amount for a short period of time to take slack out of the wireline. For example, if the tractor speed is incrementally increased by 1 ft/min for a 1 minute interval and then returned to the previous speed, then 1 foot of slack should be removed between the winch and the tractor. This can be done until an increase in wireline tension is observed.

When small amounts of slack are added or removed between the winch and tractor, the wireline tension can indicate when the slack has just been removed. A counter can be zeroed at this point. The counter can track the difference between the amount of wireline spooled by the winch system and the distance the tractor should have moved as calculated by the tractor running speed and time interval. Alternately the counter can track the difference between the amount of wireline spooled by the winch system and the actual distance the tractor moved as measured by a measurement means associated with the tool string. If the winch started running faster than the tractor it should be detected by this counter, as it may not show up on the tension. By monitoring the counter, periodically making adjustment to the tractor speed, and re-zeroing the counter when synchronization is confirmed, the synchronization of the winch and tractor should be improved. Keeping the tractor and winch synchronized will maximize conveyance force by minimizing the amount of unnecessary pull between the winch and tractor and improve depth control, particularly if the operation involves logging while tractoring.

The current disclosed method of operating a variable speed tractor makes it easier to synchronize the tractor and winch to the same speed, without undue slack in the wireline. The current disclosed method increases the reliability of successfully conveying a payload and increases the accuracy of depth control of the tractor during conveyance.

In an embodiment the following steps can be followed: (a) When it is required to start tractor conveyance, the tractor and winch will be started at the same nominal speed. The exact speeds of the winch deployment of the wireline and the tractor are likely to differ at this point in time. (b) Adjust the speed of the tractor in small increments up or down to match the winch using a wireline tension as an indicator of when the tractor is pulling against the winch and guiding whether the tractor needs to speed up or slow down. A reading of downhole wireline tension is desirable and should be a better indication than a reading of wireline tension at the winch. A GUI (Graphical User Interface) could be used and could include buttons to increment or decrement the tractor speed in small increments. (c) Increase or decrease the speed of the tractor a small increments for a known time period to add or remove slack from the wireline, returning to the original speed. Observe wireline tension as an indicator of obtaining the desired result. The GUI could include buttons to Remove 1 ft of slack and Add 1 ft of slack. (d) Monitor wireline tension. The periodic need to either add or remove slack will be an indicator that a further speed correction could be beneficial. (e) If the tractor speeds are matched, periodically adding and/or removing slack while observing the wireline tension can confirm the tractor and winch are still synchronized. (f) A counter can be used that is zeroed when the wireline tension confirms that adding and removing slack indicates there is no slack in the wireline. The counter can track the difference in measured winch movement and calculated or measured tractor movement, to indicate when synchronization might be compromised. An embodiment of the method for synchronizing downhole tractor and surface winch deployment includes taking downhole wireline tension readings. An embodiment of the method for synchronizing downhole tractor and surface winch deployment includes taking measured downhole tractor movement readings.

An embodiment of the method for synchronizing downhole tractor and surface winch deployment includes deploying both the tractor and winch at the same nominal speed, obtaining readings of wireline tension, to indicate whether the tractor needs to speed up or slow down, and adjusting the speed of the tractor in small increments to match the winch speed. The wireline tension readings can be downhole wireline tension readings, which can be observed as an indicator of obtaining substantially matching tractor and winch speeds. If the tractor and winch speeds are substantially matched, periodically adding and/or removing slack while observing the wireline tension can be used to confirm the tractor and winch are still synchronized. A real-time downhole wireline tension transmitter can be used for transmitting wireline tension information. A counter can be implemented that can be zeroed when the wireline tension confirms that adding and removing slack indicates there is no slack in the wireline. An optional information handling system can be used to track readings and establish patterns to better monitor the operation. In some embodiments, a controller in communication with the tractor, such as the tractor 130 of FIG. 1 and the wireline tension readings is used to adjust the tractor speed in response to indications when synchronization might be compromised.

FIG. 6 is a system diagram 600 of a downhole tractor synchronization system, in accordance with an embodiment of the present disclosure. At block 602, an operator defined reference speed (e.g., 1 ft/min, 10 ft/min, or another speed) is obtained. At block 604, a value of a reference downhole tension is obtained. In some embodiments, the value of the reference downhole tension varies as a function of depth, inclination, debris in the well, and/or other downhole properties. In some embodiments, the value of the reference downhole tension is based on the speed of the winch, the downhole environment, and/or the condition of the downhole tractor, such as the tractor 130. In some embodiments, the value of the reference downhole tension is pre-determined by an operator. Further, at block 606, a value of the actual downhole tension is obtained. At block 608, the downhole tractor synchronization system determines an error between the reference downhole tension and the actual downhole tension, where the error is the difference between the reference downhole tension and the actual downhole tension. More particularly, the error has a positive value if the value of the reference downhole tension is greater than the value of the actual downhole tension, and the error has a negative value if the value of the reference downhole tension is less than the value of the actual downhole tension. For example, a decrease in the winch speed would cause an increase in the actual downhole tension, thereby resulting in a negative error. At block 610, the error is provided as an input to a controller, such as a PI controller or a PID controller, In some embodiments, a positive input (where the value of the reference downhole tension is greater than the value of the actual downhole tension) of the controller results in an increased output, whereas a negative input (where the value of the reference downhole tension is less than the value of the actual downhole tension) of the controller results in a decreased controller output. At block 612, the downhole tractor synchronization system determines an error between the operator defined reference speed and the output of the controller, where the error is the sum of the operator defined reference speed and the output of the controller. Continuing with the foregoing example, where a decrease in the winch speed resulted in the error determined at block 608 and the output of the controller to have negative values, the value of the error determined at block 612 would be less (e.g., 1 ft/min, 2 ft/min, or another value) than the value of operator defined reference speed. At block 614, the result of the error determined at block 612 is utilized to determine a modified speed of the tractor, where the tractor's speed is adjusted based on the value of the modified speed. For example, where the tractor was operating at 10 ft/min, and the modified speed of the tractor is determined to be 9 ft/min, the tractor speed is subsequently adjusted to 9 ft/min.

In another example, an increase in the winch speed would cause a decrease in the actual downhole tension, resulting in an error having a positive value. The positive value is inputted into the controller at block 610 to obtain a positive output. Moreover, at block 612, the result of the error between the operator defined reference speed and the output of the controller is a value that is greater than the operator defined reference speed. At block 614, the result of the error determined at block 612 is utilized to determine a modified speed of the tractor, where the tractor's speed is adjusted based on the value of the modified speed. For example, where the tractor was operating at 10 ft/min, and the modified speed of the tractor is determined to be 11 ft/min, the tractor speed is subsequently adjusted to 11 ft/min. In some embodiments, where the modified speed determined at block 614 is within a threshold range of the operator defined reference speed (e.g., within +/−1 ft/min), then the speed of the tractor is not adjusted. In some embodiments, the foregoing operations are periodically (e.g., once per minute, once per hour, once every second, etc.) performed. In some embodiments, the foregoing operations are dynamically performed while the tractor is deployed downhole.

FIG. 7 is another system diagram 700 of a downhole tractor synchronization system, in accordance with another embodiment of the present disclosure. At block 702, an operator defined torque threshold is obtained. At block 704, a value of a reference downhole tension is obtained. Further, at block 706, a value of the actual downhole tension is obtained. At block 708, the downhole tractor synchronization system determines an error between the reference downhole tension and the actual downhole tension, where the error is the difference between the reference downhole tension and the actual downhole tension. More particularly, the error has a positive value if the value of the reference downhole tension is greater than the value of the actual downhole tension, and the error has a negative value if the value of the reference downhole tension is less than the value of the actual downhole tension. For example, a decrease in the winch speed would cause an increase in the actual downhole tension, thereby resulting in a negative error. At block 710, the error is provided as an input to a controller, such as a PI controller or a PID controller. In some embodiments, a positive input (where the value of the reference downhole tension is greater than the value of the actual downhole tension) of the controller results in an increased controller output, whereas a negative input (where the value of the reference downhole tension is less than the value of the actual downhole tension) of the controller results in a decreased controller output. At block 712, the downhole tractor synchronization system determines an error between the operator defined torque and the output of the controller, where the error is the sum of the operator defined reference speed and the output of the controller. Continuing with the foregoing example, where a decrease in the winch speed resulted in the error determined at block 708 and the output of the controller to have negative values, the value of the error determined at block 712 would be than the value of operator defined reference torque. At block 714, the result of the error determined at block 712 is utilized to determine a modified torque threshold of the tractor, where the tractor's maximum torque is adjusted based on the value of the modified torque threshold. For example, where the tractor was operating at 100 lbf·ft, and the modified speed of the tractor is determined to be 90 lbf·ft, the tractor maximum torque is subsequently adjusted to 90 lbf·ft. The decrease in the maximum torque of the tractor reduces the speed of the tractor, which in turn, synchronizes the winch speed and the tractor speed. In some embodiments, the foregoing operations are periodically (e.g., once per minute, once per hour, once every second, etc.) performed. In some embodiments, the foregoing operations are dynamically performed while the tractor is deployed downhole.

FIG. 8 is a block diagram of a downhole tractor synchronization system 800. Downhole tractor synchronization system 800 includes a storage medium 806 and processors 810. Storage medium 806 may be formed from data storage components such as, but not limited to, read-only memory (ROM), random access memory (RAM), flash memory, magnetic hard drives, solid-state hard drives, CD-ROM drives, DVD drives, floppy disk drives, as well as other types of data storage components and devices. In some embodiments, storage medium 806 includes multiple data storage devices. In further embodiments, the multiple data storage devices may be physically stored at different locations. Data indicative of the tractor, winch, downhole conditions (collectively referred to as "tractor data") are stored at a first location 820 of storage medium 806. Further, instructions to deploy the tractor are stored at a second location 822 of the storage medium 806. Further, instructions to deploy the wireline from a winch are stored at a third location 824 of the storage medium 806. Further, instructions to dynamically monitor a wireline tension as an indicator of synchronization of the tractor and winch are stored at a fourth location 826 of the storage medium. Further, instructions to adjust the tractor speed in response to a disparity in tension to match the winch speed are stored at a fifth location 830 of the storage medium 800.

The text above describes one or more specific embodiments of a broader disclosure. The disclosure also is carried out in a variety of alternate embodiments and thus is not limited to those described here. The foregoing description of an embodiment of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not by this detailed description, but rather by the claims appended hereto.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method for synchronizing downhole tractor and surface winch deployment comprising: inserting into a wellbore a tool string connected to a wireline, the tool string comprising a variable speed tractor; deploying the tractor; deploying the wireline from a winch; dynamically monitoring, by a device disposed downhole, a wireline tension as an indicator of synchronization of the tractor and winch; and adjusting, by the device, the tractor speed in response to a disparity in tension to match the winch speed.

Clause 2, the method of clause 1, wherein adjusting the tractor speed comprises: determining an operator desired speed of the tractor; determining a reference downhole tension; determining an actual downhole tension; and determining a modified speed of the tractor based on the operator desired speed of the tractor, the reference downhole tension, and the actual downhole tension, wherein the modified speed is less than the operator desired speed if the reference downhole tension is less than the actual downhole tension, wherein the modified speed is greater than the operator desired speed if the reference downhole tension is greater than the actual downhole tension, and wherein the tractor speed is adjusted based on the modified speed.

Clause 3, the method of clause 2, further comprising: determining a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determining a second error between the operator desired speed and a value based on a result of the first error, wherein the modified speed is based on a result of the second error.

Clause 4, the method of clause 3, further comprising inputting the result of the first error into a controller, wherein the second error is determined between the operator desired speed and an output of the controller.

Clause 5, the method of clauses 3 or 4, wherein the value of the result of the second error is less than the operator desired speed if the actual downhole tension is greater than the reference downhole tension, and wherein the value of the result of the second error is greater than the operator desired speed if the actual downhole tension is less than the reference downhole tension.

Clause 6, the method of any of clauses 1-5, wherein adjusting the tractor speed comprises: determining an operator desired torque threshold of the tractor; determining a reference downhole tension; determining an actual downhole tension; and determining a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

Clause 7, the the method of clause 6, further comprising: determining a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determining a second error between the operator desired torque threshold and a value based on a result of the first error, wherein the modified torque is based on a result of the second error.

Clause 8, the method of clause 7, further comprising inputting the result of the first error into a controller, wherein the second error is determined between the operator desired torque threshold and an output of the controller.

Clause 9, the method of any of clauses 1-8, further comprising implementing a counter to indicate an amount of slack in the wireline, wherein the counter is zeroed when the wireline tension confirms that adding or removing slack indicates there is no slack in the wireline.

Clause 10, a system for synchronizing downhole tractor speed and surface winch deployment comprising: a winch for deploying a tool string on a wireline; a variable speed tractor connected to the tool string for deploying the tool string into a wellbore; a wireline tension sensor; and a downhole device in communication with the tractor and the wireline tension sensor and having one or more processors configured to: dynamically monitor wireline tension as an indication of synchronization of the tractor and winch; and dynamically adjust the speed of the tractor to match the winch speed.

Clause 11, the system of clause 10, wherein the one or more processors are configured to: determine an operator desired speed of the tractor; determine a reference downhole tension; determine an actual downhole tension; and determine a modified speed of the tractor based on the operator desired speed of the tractor, the reference downhole tension, and the actual downhole tension, wherein the modified speed is less than the operator desired speed if the reference downhole tension is less than the actual downhole tension, wherein the modified speed is greater than the operator desired speed if the reference downhole tension is greater than the actual downhole tension, and wherein the tractor speed is adjusted based on the modified speed.

Clause 12, the system of clause 11, wherein the one or more processors are configured to: determine a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determine a second error between the operator desired speed and a value based on a result of the first error, wherein the modified speed is based on a result of the second error, wherein the value of the result of the second error is less than the operator desired speed if the actual downhole tension is greater than the reference downhole tension, and wherein the value of the result of the second error is greater than the operator desired speed if the actual downhole tension is less than the reference downhole tension.

Clause 13, the system of clause 12, wherein the one or more processors are configured to: determine an operator desired torque threshold of the tractor; determine a reference downhole tension; determine an actual downhole tension; and determine a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

Clause 14, a method for synchronizing downhole tractor and surface winch deployment comprising: inserting into a wellbore a tool string connected to a wireline, the tool string comprising a variable speed tractor; deploying the tractor; deploying the wireline from a winch; dynamically monitoring, by a device disposed downhole, a wireline tension as an indicator of synchronization of the tractor and winch; implementing a counter to indicate an amount of slack in the wireline, wherein the counter is zeroed when the wireline tension confirms that adding or removing slack indicates there is no slack in the wireline; and adjusting the tractor speed in response to a disparity in tension to match the winch speed.

Clause 15, the method of clause 14, further comprising: incrementally increasing the tractor speed in response to wireline tension that is unchanging, until an increase in wireline tension is observed.

Clause 16, the method of clauses 14 or 15, further comprising: incrementally decreasing the tractor speed in response to wireline tension that is increasing, until the wireline tension is observed to stabilize.

Clause 17, the method of any of clauses 14-16, further comprising: utilizing downhole wireline tension as an indicator of obtaining substantially matching tractor and winch speeds.

Clause 18, the method of any of clauses 14-17, further comprising: periodically adding or removing slack in the wireline by adjusting the tractor speed while observing the wireline tension, to confirm whether the tractor and winch are synchronized.

Clause 19, the method of any of clauses 14-18, wherein the tractor speed is adjusted by a downhole device deployed downhole that is configured to: determine an operator desired speed of the tractor; determine a reference downhole tension; determine an actual downhole tension; and determine a modified speed of the tractor based on the operator desired speed of the tractor, the reference downhole tension, and the actual downhole tension, wherein the modified speed is less than the operator desired speed if the reference downhole tension is less than the actual downhole tension, wherein the modified speed is greater than the operator desired speed if the reference downhole tension is greater than the actual downhole tension, and wherein the tractor speed is adjusted based on the modified speed.

Clause 20, the method of clauses 14-19, wherein the tractor speed is adjusted by a downhole device that is configured to: determine an operator desired torque threshold of the tractor; determine a reference downhole tension; determine an actual downhole tension; and determine a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claims is:

1. A method for synchronizing downhole tractor and surface winch deployment comprising:

inserting into a wellbore a tool string connected to a wireline, the tool string comprising a variable speed tractor;

deploying the tractor;

deploying the wireline from a winch;

dynamically monitoring, by a device disposed downhole, a wireline tension as an indicator of synchronization of the tractor and winch;

determining an operator desired speed of the tractor;

determining a reference downhole tension;

determining an actual downhole tension;

determining a modified speed of the tractor based on the operator desired speed of the tractor, the reference downhole tension, and the actual downhole tension; and adjusting, by the device, the tractor speed in response to a disparity in tension to match the winch speed, wherein the tractor speed is adjusted based on the modified speed.

2. The method of claim 1, wherein the modified speed is less than the operator desired speed if the reference downhole tension is less than the actual downhole tension, and wherein the modified speed is greater than the operator desired speed if the reference downhole tension is greater than the actual downhole tension.

3. The method of claim 2, further comprising:

determining a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determining a second error between the operator desired speed and a value based on a result of the first error, wherein the modified speed is based on a result of the second error.

4. The method of claim 3, further comprising inputting the result of the first error into a controller, wherein the second error is determined between the operator desired speed and an output of the controller.

5. The method of claim 3, wherein the value of the result of the second error is less than the operator desired speed if the actual downhole tension is greater than the reference downhole tension, and wherein the value of the result of the second error is greater than the operator desired speed if the actual downhole tension is less than the reference downhole tension.

6. The method of claim 1, wherein adjusting the tractor speed comprises:

determining an operator desired torque threshold of the tractor;

determining a reference downhole tension;

determining an actual downhole tension; and determining a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

7. The method of claim 6, further comprising:

determining a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determining a second error between the operator desired torque threshold and a value based on a result of the first error, wherein the modified torque is based on a result of the second error.

8. The method of claim 7, further comprising inputting the result of the first error into a controller, wherein the second error is determined between the operator desired torque threshold and an output of the controller.

9. The method of claim 1, further comprising implementing a counter to indicate an amount of slack in the wireline, wherein the counter is zeroed when the wireline tension confirms that adding or removing slack indicates there is no slack in the wireline.

10. A system for synchronizing downhole tractor speed and surface winch deployment comprising:

a winch for deploying a tool string on a wireline;

a variable speed tractor connected to the tool string for deploying the tool string into a wellbore;

a wireline tension sensor; and a downhole device in communication with the tractor and the wireline tension sensor and having one or more processors configured to:

dynamically monitor wireline tension as an indication of synchronization of the tractor and winch;

determine an operator desired speed of the tractor;

determine a reference downhole tension;

determine an actual downhole tension; and determine a modified speed of the tractor based on the operator desired speed of the tractor, the reference downhole tension, and the actual downhole tension; and dynamically adjust the speed of the tractor to match the winch speed wherein the tractor speed is adjusted based on the modified speed.

11. The system of claim 10, wherein the modified speed is less than the operator desired speed if the reference downhole tension is less than the actual downhole tension, and wherein the modified speed is greater than the operator desired speed if the reference downhole tension is greater than the actual downhole tension.

12. The system of claim 11, wherein the one or more processors are configured to:

determine a first error between the reference downhole tension and the actual downhole tension, wherein the first error has a negative value if the reference downhole tension is less than the actual downhole tension, and wherein the first error has a positive value if the reference downhole tension is greater than the actual downhole tension; and determine a second error between the operator desired speed and a value based on a result of the first error, wherein the modified speed is based on a result of the second error, wherein the value of the result of the second error is less than the operator desired speed if the actual downhole tension is greater than the reference downhole tension, and wherein the value of the result of the second error is greater than the operator desired speed if the actual downhole tension is less than the reference downhole tension.

13. The system of claim 12, wherein the one or more processors are configured to:

determine an operator desired torque threshold of the tractor;

determine a reference downhole tension;

determine an actual downhole tension; and determine a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

14. A method for synchronizing downhole tractor and surface winch deployment comprising:

inserting into a wellbore a tool string connected to a wireline, the tool string comprising a variable speed tractor;

deploying the tractor;

deploying the wireline from a winch;

dynamically monitoring, by a device disposed downhole, a wireline tension as an indicator of synchronization of the tractor and winch;

implementing a counter to indicate an amount of slack in the wireline, wherein the counter is zeroed when the wireline tension confirms that adding or removing slack indicates there is no slack in the wireline; and adjusting the tractor speed in response to a disparity in tension to match the winch speed.

15. The method of claim 14, further comprising: incrementally increasing the tractor speed in response to wireline tension that is unchanging, until an increase in wireline tension is observed.

16. The method of claim 14, further comprising: incrementally decreasing the tractor speed in response to wireline tension that is increasing, until the wireline tension is observed to stabilize.

17. The method of claim 14, further comprising: utilizing downhole wireline tension as an indicator of obtaining substantially matching tractor and winch speeds.

18. The method of claim 14, further comprising: periodically adding or removing slack in the wireline by adjusting the tractor speed while observing the wireline tension, to confirm whether the tractor and winch are synchronized.

19. The method of claim 14, wherein the tractor speed is adjusted by a downhole device deployed downhole that is configured to:

determine an operator desired speed of the tractor;

determine a reference downhole tension;

determine an actual downhole tension; and determine a modified speed of the tractor based on the operator desired speed of the tractor, the reference downhole tension, and the actual downhole tension, wherein the modified speed is less than the operator desired speed if the reference downhole tension is less than the actual downhole tension, wherein the modified speed is greater than the operator desired speed if the reference downhole tension is greater than the actual downhole tension, and wherein the tractor speed is adjusted based on the modified speed.

20. The method of claim 14, wherein the tractor speed is adjusted by a downhole device that is configured to:

determine an operator desired torque threshold of the tractor;

determine a reference downhole tension;

determine an actual downhole tension; and determine a modified torque of the tractor based on the operator desired torque threshold of the tractor, the reference downhole tension, and the actual downhole tension, wherein the modified torque is less than the operator desired torque threshold if the reference downhole tension is less than the actual downhole tension.

* * * * *